US009273446B2

(12) United States Patent
Manchester

(10) Patent No.: US 9,273,446 B2
(45) Date of Patent: Mar. 1, 2016

(54) STEERABLE UNDERWATER TRENCHING APPARATUS

(71) Applicant: IHC Engineering Business Limited, Northumberland (GB)

(72) Inventor: Jonathan Ralph Manchester, Rowlands Gill (GB)

(73) Assignee: IHC ENGINEERING BUSINESS LIMITED, Sliedrecht (NL)

( * ) Notice: Subject to any disclaimer, the term of this patent is extended or adjusted under 35 U.S.C. 154(b) by 25 days.

(21) Appl. No.: 14/353,108

(22) PCT Filed: Oct. 26, 2012

(86) PCT No.: PCT/GB2012/052667
§ 371 (c)(1),
(2) Date: Apr. 21, 2014

(87) PCT Pub. No.: WO2013/061075
PCT Pub. Date: May 2, 2013

(65) Prior Publication Data

US 2014/0338232 A1 Nov. 20, 2014

(30) Foreign Application Priority Data

Oct. 26, 2011 (GB) ..... 1118503.0

(51) Int. Cl.
*E02F 9/02* (2006.01)
*E02F 5/10* (2006.01)

(52) U.S. Cl.
CPC ..... *E02F 9/026* (2013.01); *E02F 5/105* (2013.01); *E02F 5/109* (2013.01); *E02F 9/024* (2013.01); *E02F 9/028* (2013.01)

(58) Field of Classification Search
USPC ..... 37/307; 405/180
IPC ..... E02F 9/006,9/024, 9/026, 5/105
See application file for complete search history.

(56) References Cited

U.S. PATENT DOCUMENTS 1,804,816 A * 5/1931 Shelton ..... 180/9.46
3,434,297 A * 3/1969 Spollen et al. ..... 405/160

(Continued)

FOREIGN PATENT DOCUMENTS

DE 20015204 U1 1/2001
EP 1167636 A 1/2002

(Continued)

OTHER PUBLICATIONS

Great Britain Search Report dated Feb. 23, 2012.

*Primary Examiner* — Gary Hartmann
(74) *Attorney, Agent, or Firm* — Troutman Sanders LLP; Ryan A. Schneider; Christopher Close, Jr.

(57) ABSTRACT

An underwater trenching apparatus comprises at least one trenching tool; a lifting attachment point configured for attachment of a lifting means for lowering the trenching apparatus to, or raising the trenching apparatus from, its location of operation; at least two steerable endless track units for transmitting tractive effort to move the underwater trenching apparatus in use; and for each steerable endless track unit, a first mounting arrangement permitting rotation of the track unit about a vertical axis, and a first actuator configured to move the track unit about the vertical axis, and control means configured to control the action of the actuator. In alternative forms, in addition to, or alternative to the steerable endless track units, the apparatus includes height adjustment means for adjusting the vertical spacing between the main body portion and the respective endless tracks; and control means configured to control the action of the height adjustment means.

15 Claims, 4 Drawing Sheets

(56) References Cited

U.S. PATENT DOCUMENTS

| | | | | |
|---|---|---|---|---|
| 3,435,908 | A | 4/1969 | Sunderlin et al. | |
| 3,755,932 | A * | 9/1973 | Cargile, Jr. | 37/331 |
| 3,900,077 | A | 8/1975 | Gee et al. | |
| 4,053,181 | A * | 10/1977 | Saito | 299/9 |
| 4,195,426 | A * | 4/1980 | Banzoli et al. | 37/309 |
| 4,214,387 | A | 7/1980 | Boehme et al. | |
| 4,362,436 | A | 12/1982 | Harmstorf | |
| 4,387,814 | A * | 6/1983 | Beduhn et al. | 212/195 |
| 4,579,182 | A * | 4/1986 | Dewing et al. | 180/9.46 |
| 6,176,334 | B1 | 1/2001 | Lorenzen | |
| 6,482,053 | B1 * | 11/2002 | Prestenbach | 440/12.63 |

FOREIGN PATENT DOCUMENTS

| | | | |
|---|---|---|---|
| GB | 1466487 | A | 3/1977 |
| GB | 2446142 | A | 8/2008 |
| GB | 2462435 | A | 2/2010 |
| NL | 9201058 | A | 6/1992 |
| NL | 9201058 | A | 1/1994 |
| WO | 9811304 | A1 | 3/1998 |
| WO | 9954556 | A | 10/1999 |

* cited by examiner

STEERABLE UNDERWATER TRENCHING APPARATUS

CROSS-REFERENCE TO RELATED PATENT APPLICATIONS

This application is a United States National Stage Application of, and claims the benefit pursuant to 35 U.S.C. §371 of International Patent Application Serial No. PCT/GB2012/052667, filed on Oct. 26, 2012, which claims priority to and the benefit of Great Britain Application No. 1118503.0, filed on Oct. 26, 2011, both which are incorporated herein in their entirety by reference.

The present invention relates to an apparatus for forming a trench in the bed of a body of water, such as the bed of a lake or the seabed. Such trenches are commonly required for burying underwater pipelines or cables, in order to protect the pipeline or cable from damage. A variety of trenching apparatus suitable for use in an underwater environment is known. Hereinafter "subsea" is used to refer to environments beneath the sea or beneath a lake, and "seabed" is used to refer to the bed of a lake or the seabed.

The present invention relates in particular to the formation of a trench in hard seabed soils. More especially the present invention relates to forming a seabed trench using a tracked vehicle, and to such tracked vehicles.

BACKGROUND

Tracked vehicles are known for use on land and for use in the subsea environment. Such vehicles are usually carried on endless articulated tracks which may, for example, be driven by sprocket wheels engaging internal parts of the endless track. Articulated vehicle tracks have the advantage of spreading the weight of the vehicle over a large contact area.

In the subsea environment, especially in connection with laying of pipes or cables in a trench vehicles with endless articulated tracks have some disadvantages. For example, when, during trenching operations, it is necessary to correct the course of the trenching vehicle (i.e. to change its direction) conventional skid steering reduces the tractive effort of the vehicle, and can cause sinkage of the tracks into the seabed, and loss of trench cutting performance. Conventional skid steering changes the relative speed of the articulated tracks at opposed sides of the vehicle in order to effect the change in direction.

Skid steering often causes pitching of the vehicle which can result in disadvantageously high loading of the trench forming tool carried by the vehicle and also problems in the grading of the trench (i.e. the inclination of the trench base). These problems can also occur as the tracked vehicle passes over objects (for example rocks or debris) on the seabed which may similarly cause pitching of the vehicle.

A further problem can occur when a subsea trench cutting apparatus is lowered from a service vessel (for example) to the seabed. If the approach speed of the apparatus is too great, the apparatus can be damaged on contact with the seabed.

The present invention seeks to overcome or alleviate some or all of the above problems.

BRIEF SUMMARY OF THE INVENTION

According to a first aspect of the present invention there is provided an underwater trenching apparatus comprising:

at least one trenching tool;

a lifting attachment point configured for attachment of a lifting means for lowering the trenching apparatus to, or raising the trenching apparatus from, its location of operation; at least two steerable endless track units for transmitting tractive effort to move the underwater trenching apparatus in use; and for each steerable endless track unit, a first mounting arrangement permitting rotation of the track unit about a vertical axis, and a first actuator configured to move the track unit about the vertical axis, and control means configured to control the action of the actuator.

According to a second aspect of the invention there is provided an underwater trenching apparatus comprising at least one trenching tool;

a lifting attachment point configured for attachment of lifting means for lowering the trenching apparatus to, or raising the apparatus from, its location of operation;

at least two endless track units for transmitting tractive effort to move the underwater trenching apparatus in use;

a main body portion to which the lifting attachment portion is attached and to which the endless tracks are mounted;

height adjustment means for adjusting the vertical spacing between the main body portion and the respective endless tracks; and control means configured to control the action of the height adjustment means.

Preferably in the first aspect of the invention the apparatus further comprises a main body portion to which the lifting attachment portion is attached and to which the endless track units are mounted, height adjustment means for adjusting the vertical spacing between the main body portion and the respective endless track units; and control means configured to control the action of the height adjustment means.

Preferably in the second aspect of the invention the apparatus further comprises:

at least two steerable endless track units for transmitting tractive effort to move the underwater trenching apparatus in use; and for each steerable endless track unit, a first mounting arrangement permitting rotation of the track unit about a vertical axis, and a first actuator configured to move the track unit about the vertical axis, and control means configured to control the action of the actuator.

Preferably the apparatus of the first or second aspect further comprises, for each endless track unit a second mounting arrangement permitting rotation of the endless track unit about a horizontal axis arranged substantially perpendicularly to the direction of movement of the track unit, and a second actuator configured to move the endless track unit about the horizontal axis and control means adapted to control the action of the second actuator.

In preferred embodiments the lifting attachment point is centrally located with respect to the endless track units.

Preferably the height adjustment means includes one or more dampers configured to reduce contact loads on the endless track units when the endless track units contact the seabed on lowering of the trenching apparatus to the seabed.

In preferred embodiments the trenching tool is mounted centrally with respect to the endless track units.

In further embodiments the control means is operable to control the respective first actuators of the endless track units independently of the other endless track unit(s).

In some preferred embodiments the underwater trenching apparatus comprises two steerable endless track units.

In other preferred embodiments the underwater trenching apparatus comprises two steerable endless track units and two non-steerable endless track units.

In other preferred embodiments the underwater trenching apparatus comprises four steerable endless track units.

In other preferred embodiments each endless track unit is independently steerable.

In further preferred embodiments, each endless track unit comprises a single endless track mounted on a subframe and wherein said first actuator is connected to said subframe.

In other preferred embodiments each endless track unit comprises a further actuator configured to move the track unit about the vertical axis.

Preferably said first actuator and said further actuator cooperate to move said endless track unit about the vertical axis.

Preferably the height adjustment means and control means of a given endless track unit are operable to adjust the vertical spacing between the main body portion and a given endless track unit independently of the spacing between the main body portion and a different endless track unit.

BRIEF DESCRIPTION OF THE DRAWINGS

For a better understanding of the invention and to show how the same may be carried into effect, reference will be made, by way of example only, to the following drawings, in which.

DETAILED DESCRIPTION

Figure 1:
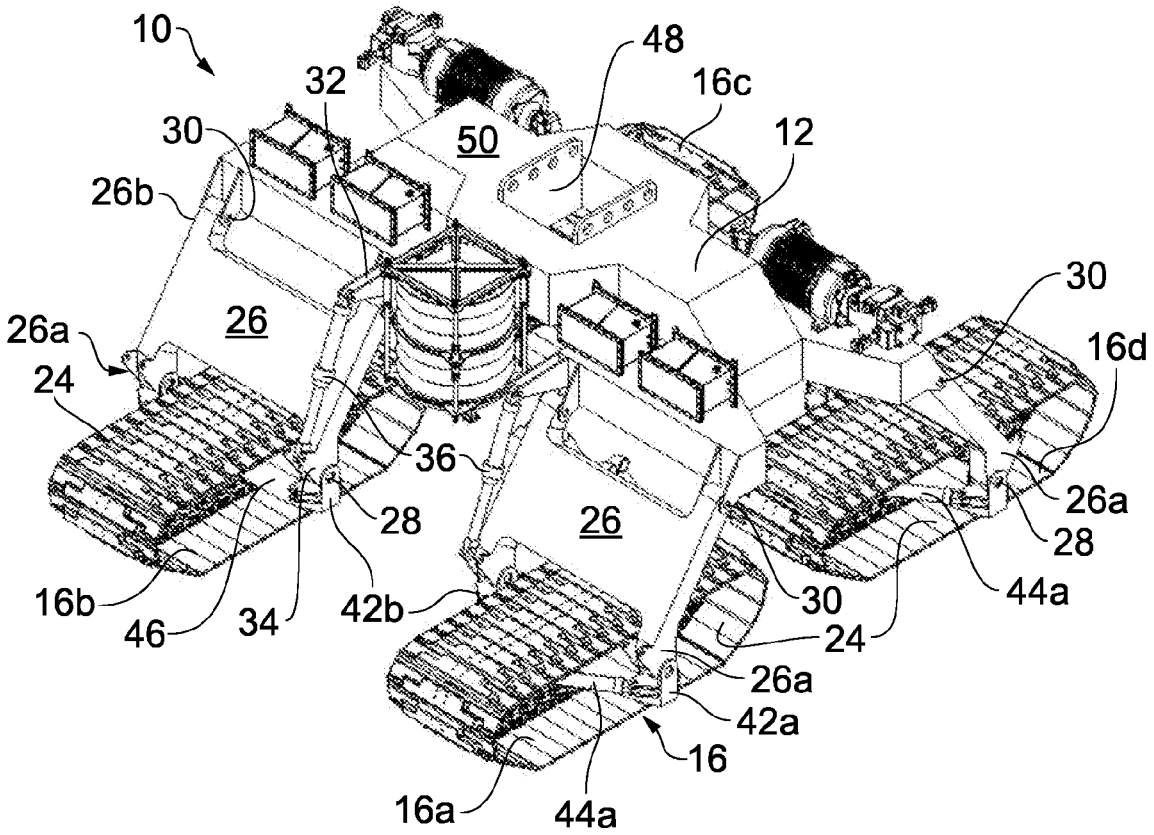
FIG. 1 is a perspective view of a subsea trench cutting apparatus according to the present invention.
Figure 2:
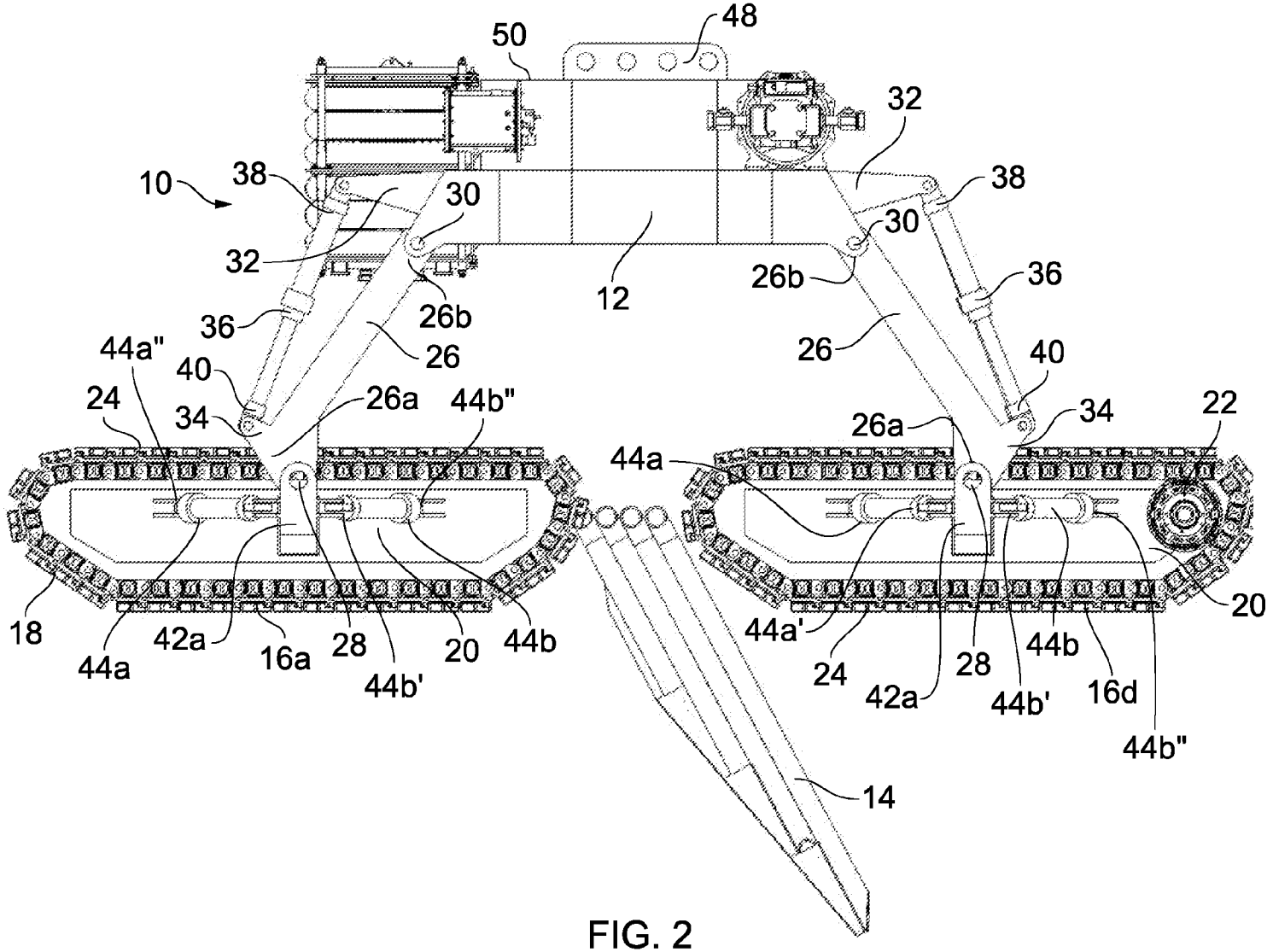
FIG. 2 is a side view of the apparatus of FIG. 1.

Referring now to the drawings, there is shown a trenching apparatus 10 comprising a main body portion 12 and a trenching tool 14. The trenching tool 14 may, in principle, be any suitable tool for cutting a subsea trench as known in the art, the most suitable tool being selected by the person of skill in accordance with, for example, the subsea ground conditions. Suitable trenching tools (14) include (but are not limited to) jetting tools, chain cutters, augers, rockwheels and the like.

The trenching apparatus 10 as illustrated in FIGS. 1 to 4 includes four endless track units 16, indicated at 16*a*, 16*b*, 16*c* and 16*d*. In variations of the invention, other numbers of endless track units may be provided, for example, 2, 6 or 8 endless track units. Each endless track unit 16 comprises an endless track 18 mounted on a subframe 20 and usually connected to a drive arrangement 22 which moves the endless track 18 around the subframe 20 and so—with the endless tracks in contact with the ground—propels the apparatus 10 over the ground. In some cases, separate propulsion means may be provided, such as a subsea tractor or a tow line from a surface vessel, but these are less preferred.

Each endless track 18 consists of a number of individual track elements 24, each of which elements 24 is articulatedly joined to its neighbour so to form an endless loop. Articulated tracks 18 and their drive means 22 are known per se in the art and any suitable design configured for subsea use may be employed with the apparatus 10 of the present invention.

Each endless track unit 16 is attached to the respective frame or leg 26 which is, in turn attached to the main body portion 12. In particular, each endless track unit 16 is attached to a first end 26*a* of a respective leg 26, an opposed second end 26*b* of which is attached to the main body portion 12.

Each endless track unit 16 is attached to its respective first end 26*a* of leg 26 in such a manner that the endless track unit 16 can rotate with respect to the leg 26 about an axis 28. Axis 28 is nominally horizontal with respect to the orientation of the apparatus 10 shown in the Figures.

Leg 26 and endless track unit subframe 20 are most preferably configured such that nominally horizontal axis 28 is located centrally with respect to the endless track unit 16. That is, the axis 28 crosses the endless track unit 16 at a point at, or about, half way along the length of the endless track unit 16 (the length being the maximum horizontal front-to-back dimension of the endless track unit).

Because of the articulation of the endless track unit 16 with respect to its leg 26, the apparatus 10 of the present invention is better able to accommodate uneven-ness in the ground (seabed) traversed by the apparatus 10.

In particular embodiments, an actuator (e.g. a hydraulic actuator) with an associated control means may be disposed between the leg 26 and the subframe 20 of the endless track unit 16, thereby to control the rotation of the endless track unit 16 about its respective nominally horizontal axis 28.

As noted above, second end 26*b*, which is the upper end as illustrated, of each leg 26 is connected to the main body portion 12. The connection or joint between each leg 26 and the main body portion 12 is such that the leg 26 can rotate with respect to the main body portion 12. In particular, the leg 26 can rotate about an axis 30 with respect to the main body portion. Axis 30 is configured to be nominally horizontal (with respect to the orientation of the apparatus as illustrated and perpendicular to the normal direction of travel of the apparatus 10). By rotation of the leg 26 about axis 30, the height of the endless track unit 16 with respect to the main body portion 12 varies. That is, rotation of leg 26 about axis 30 results in an increase or decrease (in accordance with the direction of rotation) in the vertical spacing of the endless track unit 16 from the main body portion 12. Here, "vertical" is with respect to the orientation of the apparatus 10 as shown in the Figures.

Adjacent an upper part of each leg 26, an arm or shoulder 34 extends outwardly from leg 26. Shoulder 34 and arm 32 are preferably arranged in substantially the same vertical plane. An actuator 36 extends between the arm 32 and the shoulder 34. The actuator 36 is pivotally connected at its first (upper) end 38 to a distal portion (with respect to the main body portion 12) of the arm 32 and is pivotally connected at its second (lower) end 40 to shoulder 34. Actuator 36 may be of any suitable type for underwater use. A hydraulic actuator (as illustrated) is preferred.

As will be readily apparent form the Figures, extension of actuator 36 will cause movement of leg 26 about pivot axis 30 such that the vertical spacing of the endless track unit 16 with respect to the main body portion 12 is increased. Correspondingly, retraction of the actuator 36 causes movement of leg 26 about pivot axis 30 in the opposite sense, so that the vertical spacing of the endless track unit 16 with respect to the main body portion 12 is decreased. A control means (typically an electronic control means) is provided, by means of which an operator can control the action or operation of actuator 36.

In such embodiments the apparatus 10 of the present invention is better equipped to accommodate the uneven surface of a subsea environment as each endless track unit 16 may adopt a range of orientations by rotating about its nominally horizontal axis 28. Furthermore, each respective endless track unit may thus adopt a different orientation to another respective track unit by rotating about said nominally horizontal axis. In addition, the vertical spacing of each respective endless track unit (i.e. 16*a*, 16*b*, 16*c* and 16*d*) from the body portion 12 can be changed as the apparatus 10 traverses the seabed by movement of leg 26 about pivot axis 30.

In further preferred embodiments of the invention, at least some of the endless track units 16 are steerable. That is, at least some of the endless track units are moveable about a nominally vertical axis whereby their alignment with respect to the main body portion 12 is changed or adjusted. Preferably two of the endless track units 16 are steerable, the steerable units being those arranged side-by-side with respect to the direction of travel of the apparatus 10.

Where the apparatus 10 has more than two endless track units 16, in particular where the apparatus 10 has four endless track units 16, preferably at least two of the endless track units 16 are steerable. More preferably, all of the endless track units 16 are steerable. Thus, in a preferred form of the apparatus 10, the apparatus 10 has four endless track units 16 all of which are steerable.

Each endless track unit 16 is attached to leg 26 through a pair of connection brackets 42*a*, 42*b*. Each connection bracket 42*a*, 42*b* is attached to leg 26 such that connection bracket 42*a*, 42*b* pivots about nominally horizontal axis 28. Connection bracket 42*a* is connected to a lower end portion 26*a* at an outside edge thereof. Connection bracket 42*b* is connected to a lower end portion 26*a* at an inside edge thereof. The terms "inside" and "outside" are used in relation to the apparatus 10 as a whole (and not in respect of an individual leg 26 taken in isolation). Rotation or pivoting of the endless track unit 16 about nominally horizontal axis 28 as described above is thereby achieved.

Extending between the connection brackets 42*a*, 42*b* and intersecting the endless track unit 16 is a carrying member 46. Endless track unit 16 is mounted on the carrying member 46. At its respective ends the carrying member 46 is fixedly connected to the connection brackets 42*a*, 42*b*. The carrying member 46 may be formed integrally with the respective connection brackets 42*a*, 42*b*.

Endless track units 16 which are steerable are mounted on the carrying member 46 such that the endless track unit 16 is rotatable with respect to the carrying member 46 about a nominally vertical axis (with respect to the orientation of the apparatus 10 as shown in the Figures). Typically, the subframe 20 of the endless track unit 16 is pivotally attached to the carrying member 46 to allow said rotation of the endless track unit 16 about the vertical axis.

Figure 3:
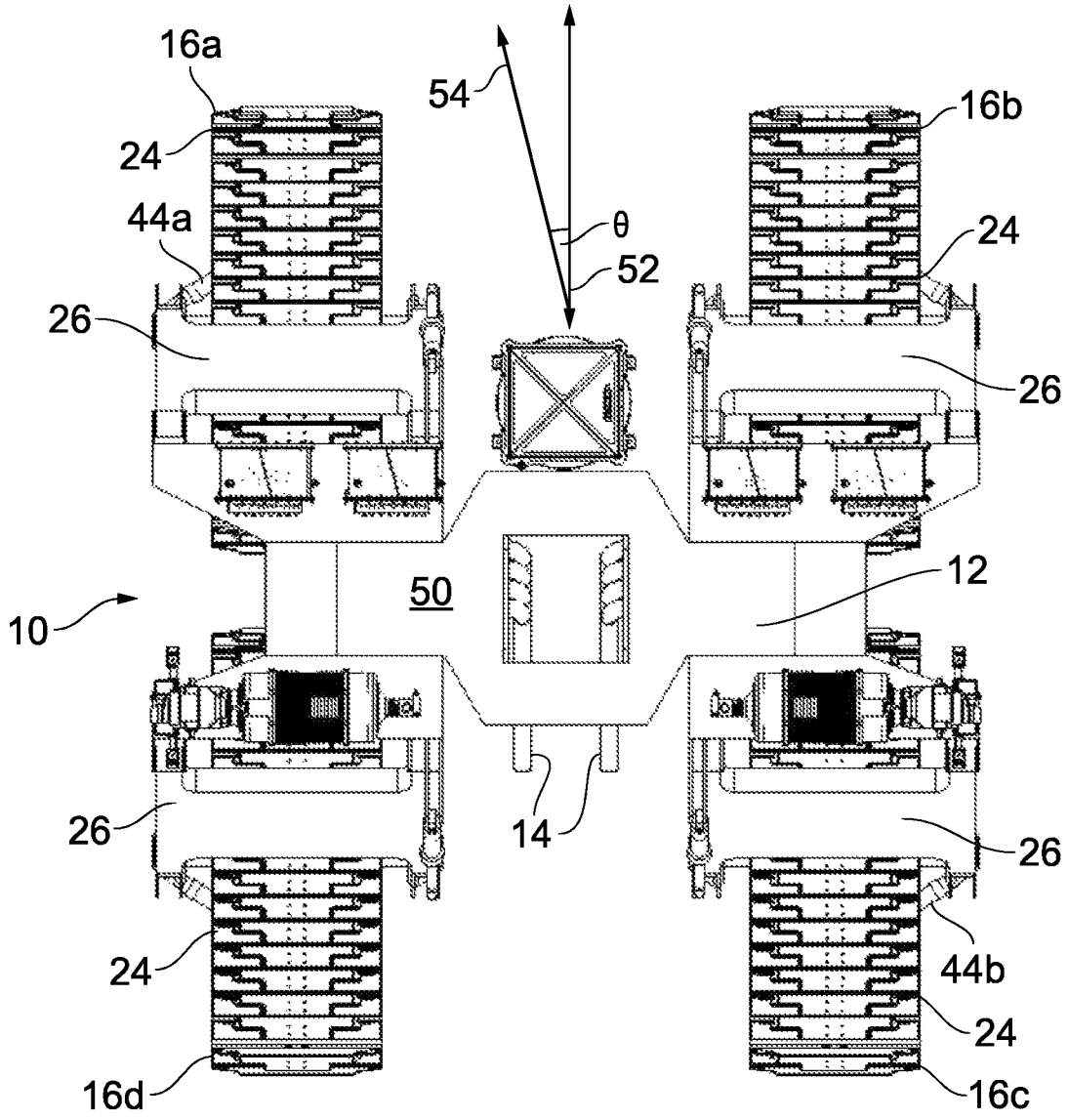
FIG. 3 is a plan view of the apparatus of FIG. 1.
Figure 4:
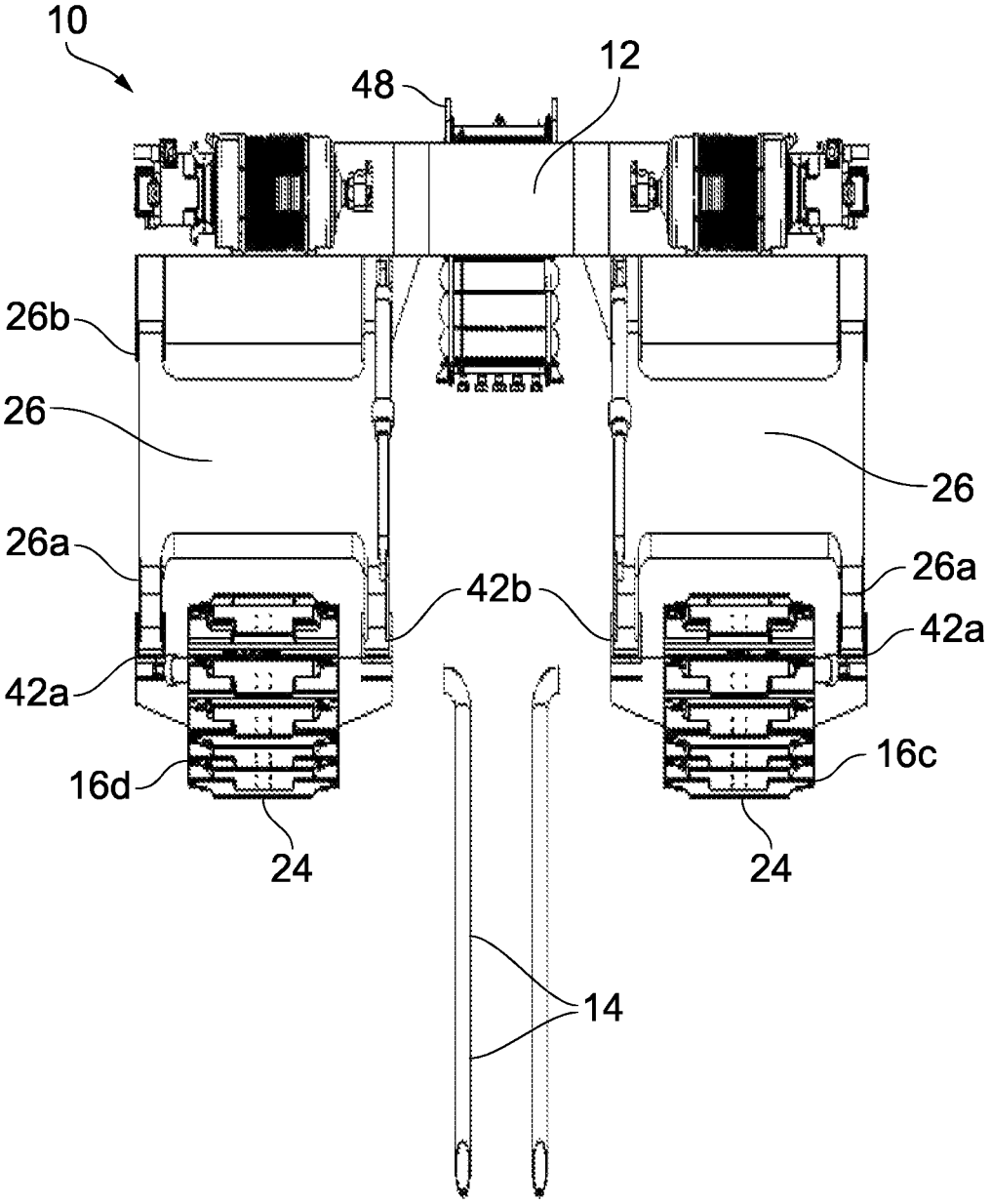
FIG. 4 is a front view of the apparatus of FIG. 1.

Steerable endless track units 16 further comprise a pair of actuators 44*a*, 44*b* which extend between the connection bracket 42*a* and the subframe 20 of the endless track unit 16. Each actuator 44*a*, 44*b* is pivotally connected at a first end 44*a*', 44*b*' to the connection bracket 42*a* and at a second end 44*a*", 44*b*" is pivotally connected to the subframe 20 of the endless track unit 16. Actuators 44*a*, 44*b* associated with a given endless track unit 16 operate as a pair to effect steering of the endless track unit 16. Thus, extension of actuator 44*a* is accompanied by a corresponding retraction of actuator 44*b* so that the endless track unit 16 is turned in an anti-clockwise (counter-clockwise) sense, as observed from above (FIG. 3). Likewise, extension of actuator 44*b* is accompanied by a corresponding retraction of actuator 44*a*, so that the endless track unit 16 is turned in a clockwise sense.

Actuators 44*a*, 44*b* may be of any type suitable for underwater use, but are preferably hydraulic actuators.

Control means are provided to control the motion or operation of the actuators 44*a*, 44*b* whereby an operator can adjust the angular position (about the vertical axis) of the steerable endless track unit 16 with respect to the main body 12. The apparatus 10 can thus be steered by an operator. In other words, the direction of travel of the apparatus 10 can be adjusted by an operator, for example in the light of operational circumstances such as ground conditions.

In some advantageous embodiments of the invention, each steerable endless track unit 16 is independently steerable. That is, the control means provides for extension/retraction of the actuators 44*a*, 44*b* associated with an endless track unit 16 independently of the state of operation of the actuators 44*a*, 44*b* associated with a different endless track unit 16.

In embodiments wherein the steerable track units 16 are independently steerable, the track units are moveable about a nominally vertical axis such that the alignment of each respective track unit 16 may be changed or adjusted with respect to the main body portion 12. Thus track unit 16*a*, for example, may be moved about a nominally vertical axis by a greater or lesser extent in comparison to track units 16*b*, 16*c* and 16*d*. Track unit 16*a* will therefore adopt a different alignment with respect to the main body portion 12 in comparison to track units 16*b*, 16*c* and 16*d*. Hence each track unit may respectively adopt a range of orientations in a horizontal plane independently of the configuration of the other track units. Advantageously the provision of independently steerable track units enhances the range of movement permissible for the underwater trenching apparatus. As the track units 16 can each independently rotate about their respective nominally vertical axes each track unit may rotate to a different extent to change the heading of the underwater trenching apparatus improving its manoeuvrability. For example, when the apparatus moves in a circular path the inwardly located track units with respect to the centre of the circle as defined by the circular path may rotate to a different extent compared to the track units outwardly located with respect to the centre of the circle defined by the circular path. By rotating the respective inwardly and outwardly located track units an appropriate amount, it is possible for embodiments of the apparatus with independently steerable track units to perform this manoeuvre in a tighter turning circle than an apparatus without independently steerable track units.

In other advantageous embodiments, endless track units 16 may be steerable in pairs. That is, for a given pair of track units, substantially the same steering operation is applied to each endless track unit 16 of the pair, so that the angular position of the each of the said endless track units 16 in the pair is substantially the same at any given time. Endless track units arranged side-by-side (such as 16*a* and 16*b*, or 16*c* and 16*d*) conveniently form steering pairs.

In other advantageous embodiments, all of the steerable endless track units are steered in unison by the control means, so that each adopts substantially the same angular position, and the control means is configured to operate accordingly.

The control means may further be configured to allow an operator to select any of the above steering configurations, that is, fully independent steering of the endless track units 16, paired steering of endless track units 16, or steering in unison of all the steerable endless track units 16.

Independent steering ability for each of the endless track units 16 further allows the apparatus 10 to adopt a so-called "crab-steering" configuration. In this configuration the control means (typically via an operator input) sets the respective actuators 44*a*, 44*b* such that each of the endless track units 16 is arranged in a substantially parallel configuration with respect to the other endless track units 16. The apparatus 10 thus moves "sideways" along an essentially straight path. For example, if the normal "straight ahead" direction of travel of the apparatus 10 is indicated in FIG. 3 by arrow 52 which is aligned with the longitudinal axis of the apparatus 10, then a "crab steering" setting of the endless track units 16 results in movement of the apparatus along a path such as that indicated by arrow 54 at an angle θ to the straight ahead direction of arrow 52. The longitudinal axis of the main body portion 12 remains aligned with arrow 52.

Main body portion 12 of apparatus 10 is provided with a lifting attachment point or formation 48. The lifting attachment formation 48 is used for the attachment of lifting cables by means of which the trenching apparatus 10 is lowered to the seabed (from a service vessel at the surface) and is raised from the seabed for return to the surface. Lifting attachment formation 48 is most preferably secured directly to the main body portion 12 of apparatus 10 and is provided with suitable components or fittings to which lifting cables may conveniently be attached.

Lifting attachment formation 48 is preferably arranged substantially centrally with respect to the main body portion, and preferably at or adjacent a top surface 50 of the main body portion 12.

Substantially central arrangement of the lifting attachment formation 48 with respect to the main body portion 12 is most preferably such that—at least as so far as is practical—the lifting attachment formation 48 is spaced substantially equidistantly from the extremities of the main body portion 12 and/or is arranged substantially equidistantly from each endless track unit 16 (or, where more than four endless track units are provided, the lifting attachment formation 48 is arranged substantially equidistantly from those endless track units 16 disposed at or near outer corners of the apparatus 10, when viewed in plan).

The above substantially central arrangement of the lifting attachment formation is achievable in the present invention because of the provision of the steerable endless track units 16.

The provision of steerable endless track units 16 as described herein is also advantageous in allowing a central location of the trenching tool 14 with respect to main body portion 12 ("central" having the same meaning as in respect of the lifting attachment formation defined above). Such central location of the trenching tool 14 is advantageous in ensuring that cutting loads (derived from the trenching operation with the trenching tool 14) are evenly distributed through the apparatus 10 whereby even pressures of each endless track on the ground (seabed) are achieved. That is, the pressure exerted by each track on the seabed is substantially the same at any time during trenching operations.

In further advantageous embodiments, the apparatus 10 of the present invention provides a damping action or effect on landing of the apparatus 10 on the seabed. That is, a damping effect is provided at the point when the apparatus 10 contacts the seabed as the apparatus 10 is lowered. A noted, the apparatus 10 is attached to lifting cables at lifting attachment formation 48 during lifting and lowering operations. The damping action achieved with the apparatus 10 significantly reduces the loading on the apparatus 10 during the landing operation thereby avoiding damage to the apparatus 10.

The damping effect or action is achieved by adjustment of the "ride height" of the apparatus 10, that is, by suitably adjusting the angular position of legs 26 about pivot axes 30 using actuators 36. The adjustment of the legs 26 takes into account the known, or expected, ground conditions of the seabed at the landing point.

Each of the legs 26 is most preferably individually adjustable, that is, without reference to the angular position of the other legs 26, An advantage of this arrangement is that the vertical spacing of each endless track unit 16 with respect to the main body portion 12 can be independently adjusted—for example in the light of particular ground conditions encountered during trenching operations—so that an even track pressure is achieved.

Furthermore, individual adjustment of the "ride height" (that is, the vertical spacing of each endless track unit 16 from the main body portion 12) can be advantageous in ensuring that the trenching tool 14 is at, or is maintained at, a desired angle. Typically the desired angle is vertical, or such angle of the tool 14 as is required to obtain a trench with the vertical sides. Deflection from the desired tool angle may occur due to ground conditions, such as unevenness of the seabed, and the independent adjustment of the legs 26 compensates accordingly.

As noted, legs 26 are operated under the control of a control means. The control means may operate automatically, or may be under the control of an operator, or may have automatic functions and operator functions, and may have a manual override of automatic functions. The same applies to each or any of the control means for the actuators 44*a*, 44*b* and actuators controlling the angular position of endless track units 16 about horizontal axis 28. Of course, a single control means may be provided to control all of, or any group or combination of, actuators provided on the apparatus 10.

The, or each, control means is preferably an electronic control means. Elements of such control means for use by an operator are desirably located at the surface (in a service vessel) or, in conjunction with suitable remote control equipment, may be located on land. Such elements can, for example, include an electronic control panel or the like.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. An underwater trenching apparatus comprising:

at least one trenching tool;

a lifting attachment point configured for attachment of a lifting means for lowering the trenching apparatus to, or raising the trenching apparatus from, its location of operation;

at least two steerable endless track units for transmitting tractive effort to move the underwater trenching apparatus in use; and a main body portion to which the lifting attachment portion is attached and to which the endless track units are mounted;

for each steerable endless track unit:

a first mounting arrangement permitting rotation of the track unit about a vertical axis;

a first actuator configured to move the track unit about the vertical axis; and control means configured to control the action of the first actuator;

wherein each steerable endless track unit is independently steerable, and wherein each endless track unit is attached to a first end of a respective leg, the second end of leg being attached to the main body portion, the track units being rotatable with respect to the respective legs about a nominally horizontal axis and the respective second ends of the legs are attached to the main body portion and are rotatable with respect to the main body portion about a nominally horizontal axis extending substantially perpendicular to the direction of travel of the apparatus.

2. The underwater trenching apparatus as claimed in claim 1 further comprising:

height adjustment means for adjusting the vertical spacing between the main body portion and the respective endless track units; and control means configured to control the action of the height adjustment means.

3. The underwater trenching apparatus as claimed in claim 1 further comprising, for each endless track unit:

a second mounting arrangement permitting rotation of the endless track unit about a horizontal axis arranged substantially perpendicularly to the direction of movement of the track unit;

a second actuator configured to move the endless track unit about the horizontal axis; and control means adapted to control the action of the second actuator.

4. The underwater trenching apparatus as claimed in claim 1, wherein the lifting attachment point is centrally located with respect to the endless track units.

5. The underwater trenching apparatus as claimed in claim 1, wherein the trenching tool is mounted centrally with respect to the endless track units.

6. The underwater trenching apparatus as claimed in claim 1, wherein the control means is operable to control the respective first actuators of the endless track units independently of the other endless track unit(s).

7. The underwater trenching apparatus as claimed in claim 1 comprising two steerable endless track units.

8. The underwater trenching apparatus as claimed in claim 7 further comprising two non-steerable endless track units.

9. The underwater trenching apparatus as claimed in claim 1 comprising four steerable endless track units.

10. The underwater apparatus as claimed in claim 1, wherein each endless track unit comprises a single endless track mounted on a subframe and wherein the first actuator is connected to the subframe.

11. The underwater apparatus as claimed in claim 1, wherein each endless track unit comprises a third actuator to move the track unit about the vertical axis.

12. The underwater apparatus as claimed in claim 11, wherein the first actuator and the third actuator cooperate to move the endless track unit about the vertical axis.

13. The underwater apparatus as claimed in claim 2, wherein the height adjustment means and control means are operable to adjust the vertical spacing between the main body portion and a given endless track unit independently of the spacing between the main body portion and a different endless track unit.

14. The underwater trenching apparatus as claimed in claim 2, wherein the height adjustment means includes one or more dampers configured to reduce contact loads on the endless track units when the endless track units contact the seabed on lowering of the trenching apparatus to the seabed.

15. The underwater apparatus as claimed in claim 2, wherein the height adjustment means and control means are operable to adjust the vertical spacing between the main body portion and a given endless track unit independently of the spacing between the main body portion and a different endless track unit.

* * * * *